US005994045A

United States Patent [19]

Bourdelais et al.

[11] Patent Number: 5,994,045

[45] **Date of Patent: *Nov. 30, 1999**

[54] COMPOSITE PHOTOGRAPHIC MATERIAL WITH LAMINATED BIAXIALLY ORIENTED POLYOLEFIN SHEETS WITH CONTROLLED WATER VAPOR TRANSMISSION RATE

[75] Inventors: Robert P. Bourdelais, Pittsford; Douglas N. Haydock, Webster; Thaddeus S. Gula, Rochester; Peter T. Aylward, Hilton, all of N.Y.

[73] Assignee: Eastman Kodak Company, Rochester, N.Y.

[ * ] Notice: This patent is subject to a terminal disclaimer.

[21] Appl. No.: 08/998,167

[22] Filed: Dec. 24, 1997

[51] Int. Cl.[6] ..... G03C 1/79; G03C 1/77

[52] U.S. Cl. ..... 430/525; 430/533; 430/536; 430/538

[58] Field of Search ..... 430/525, 536, 430/538, 533

[56] References Cited

U.S. PATENT DOCUMENTS

| | | | |
|---|---|---|---|
| 4,187,113 | 2/1980 | Mathews et al. | 40/533 |
| 4,283,486 | 8/1981 | Aono et al. | 430/538 |
| 4,377,616 | 3/1983 | Ashcraft et al. . | |
| 4,581,267 | 4/1986 | Miller | 428/40 |
| 4,632,869 | 12/1986 | Park et al. . | |
| 4,645,736 | 2/1987 | Anthonsel et al. | 430/538 |
| 4,758,462 | 7/1988 | Park et al. . | |
| 4,912,333 | 3/1990 | Roberts et al. . | |
| 4,994,312 | 2/1991 | Maier et al. . | |
| 5,192,620 | 3/1993 | Chu et al. | 428/461 |
| 5,290,671 | 3/1994 | Thomas et al. | 430/538 |
| 5,290,672 | 3/1994 | Dunk . | |
| 5,391,473 | 2/1995 | Lacz et al. | 430/536 |
| 5,429,916 | 7/1995 | Ohshima | 430/538 |
| 5,466,519 | 11/1995 | Shirakura et al. | 430/538 |
| 5,476,708 | 12/1995 | Reed et al. | 430/538 |
| 5,500,282 | 3/1996 | Heffelfinger et al. | 428/339 |
| 5,514,460 | 5/1996 | Surman et al. | 428/304.1 |
| 5,543,223 | 8/1996 | Shah | 428/346 |

FOREIGN PATENT DOCUMENTS

| | | |
|---|---|---|
| 0 803 377 A1 | 10/1997 | European Pat. Off. . |
| 0 757 284 A1 | 2/1997 | United Kingdom . |
| 0 880 066 A1 | 5/1998 | United Kingdom . |
| 0 880 068 A1 | 5/1998 | United Kingdom . |
| 0 880 069 A1 | 5/1998 | United Kingdom . |
| 2 325 750 | 5/1998 | United Kingdom . |

*Primary Examiner*—Richard L. Schilling
*Attorney, Agent, or Firm*—Paul A. Leipold

[57] ABSTRACT

This invention is generally accomplished by a photographic or imaging element comprising a paper base, at least one photosensitive silver halide layer, a tie layer and a biaxiaily oriented polyolefin sheet wherein said polyolefin sheet by itself or in combination with said tie layer has a water vapor transmission rate of less than $0.85\times10^{-5}$ g/mm$^2$/day.

19 Claims, No Drawings

COMPOSITE PHOTOGRAPHIC MATERIAL WITH LAMINATED BIAXIALLY ORIENTED POLYOLEFIN SHEETS WITH CONTROLLED WATER VAPOR TRANSMISSION RATE

FIELD OF THE INVENTION

This invention relates to photographic materials. In a preferred form it relates to base material for photographic color papers.

BACKGROUND OF THE INVENTION

In color papers there is a need for providing color papers with improved resistance to the transmission of water vapor. Present color papers are coated with a photosensitive layer (s) containing dye couplers as well as hardeners that are required to react with the gelatin to impart physical properties to control the amount of layer swelling when rewet during processing and also a degree of physical toughness to resist scratching and allow the emulsion coated paper to be slit and cut in a reasonable time. This process can be time dependent as well as sensitive to the amount of moisture in the dried emulsion and the paper base. The current photographic base has a certain propensity to allow water vapor to pass between the paper base and the emulsion layer. The rate at which this exchange occurs has an impact on the rate and ultimate hardness of the emulsion coated layer. There remains a need to reduce the water vapor transmission between the emulsion and the paper base to provide for improved hardness and improved scratch resistances. Paper by nature will absorb or give off moisture as it is exposed to varying humidity conditions. Since photographic paper has slit edges that expose paper that is not covered by a layer of polyethylene, there is a tendency for the edges of the photographic support to either gain or lose moisture at a rate that is different than the center of the web. This process creates a differential moisture profile from the edge to the center of the web. This moisture difference can then cause a difference in the response of the photosensitive components. There remains a need to reduce the moisture exchange between the emulsion and the paper base. By reducing the rate or eliminating the loss of moisture from the emulsion through the current polyethylene layer into the paper base that there will be less variation in the photographic response. Melt extruded cast polyethylene used in photographic paper has a water vapor transmission rate of at about $1.6\times10^{-5}$ g/mm$^2$/day. There remains a need for a layer between the silver halide emulsion and the paper base that has a higher resistance to the flow of water vapor from the emulsion to the paper base. There also remains a need for a layer on the backside of an emulsion coated paper base to have a high resistance to the flow of water vapor. This is important during manufacturing and photographic processing when the photographic element is in wound roll form. The photographic emulsion is between the the emulsion said and back side layers. This creates a sandwich effect on each side and allows the moisture to remain in the emulsion longer which is critical to assure hardening. There also remains a need to improve the transient core set curl of photographic paper. By reducing the water vapor transmission properties of the photographic paper an improvement can be made.

In U.S. Pat. No. 4,283,486 a mechanism to the control the oxygen flow rate through the paper base to reduce image dye discoloration was discussed. In U.S. Pat. No. 4,581,267 a method to over laminate a photographic print to protect against moisture is disclosed. A method to control the rate of water vapor transmission in packaging applications using biaxially oriented multiple layer sheets is disclosed in U.S. Pat. No. 5,543,223 and U.S. Pat. No. 5,192,620, the disclosure of which is incorporated by reference.

SUMMARY OF THE INVENTION

An object of this invention is to provide an improved photographic papers.

A further object is to provide a photographic element with improved emulsion hardness.

Another object is to provide a photosensitive element that will have less variability in the photographic response.

Another object is to provide a photographic element that has improved emulsion hardening rates.

A further object is to provide a photographic base that has an image element that is less prone to scratches and abrasions, and has less tendency to pickup dirt and to have prints block or stick together in stacks.

An additional object is to provide a photographic or imaging element that has improved transient curl properties.

These and other objects of the invention are accomplished by a photographic or imaging element comprising a paper base, at least one photosensitive silver halide layer, a tie layer and a biaxially oriented polyolefin sheet wherein said polyolefin sheet by itself or in combination with said tie layer has a water vapor transmission rate of less than $0.85\times10^{-5}$ g/mm$^2$/day.

ADVANTAGEOUS EFFECT OF THE INVENTION

The invention provides a means to control the rate of moisture migration between the paper base and the photosensitive layers. It particularly provides for faster hardening of the moisture sensitive layers, higher levels of hardness, less variability in moisture sensitive imaging elements, as well as improved transient curl performance.

DETAILED DESCRIPTION OF THE INVENTION

The invention provides numerous advantages over the prior art practices in the art of hardening photosensitive and other imaging layers that utilize a binder or dye forming system that in whole or in part has a moisture sensitive element. The invention provides a biaxially oriented sheet that has a water vapor transmission rate of less than $0.85\times10^{-5}$ g/mm$^2$/day. By providing a barrier to prevent or reduce the rate of moisture migration from the emulsion into the paper base, this invention provides for superior hardness, faster rates of hardening, reduced variability in photographic response, improved scratch and abrasion resistance. In addition to these advantages, some additional benefits are the ability to slit and chop rolls in a shorter time frame during the manufacturing process. By reducing or eliminating the loss of moisture out of the emulsion into the paper base, there is less need to control the paper base to extremely tight moisture tolerances. A reduction in the water vapor transmission rate provides for less critical moisture tolerances during the paper base manufacture which results in less waste.

In the art of manufacturing photographic paper support, there is a layer of polyethylene that is applied to the paper side under the emulsion and also a polyethylene layer on the backside of the paper. The paper base contains moisture. In the current art of photographic base manufacturing one way to affect the rate of hardening is to provide paper that has a moisture equilibrium near that of the emulsion. This method is not practical and it is very expense to do. By providing a paper base that is at or close to the moisture equilibrium of the emulsion, the moisture gradient between the emulsion and the paper base is reduced therefore slowing the loss of moisture from the emulsion. This has been found to be necessary because the photographic emulsion which contains gelatin must also include a crosslinking hardener. The crosslinking hardener requires moisture and time to allow the hardening reaction to take place. The emulsion must be hardened to provide for physical toughness and also to control the amount of swelling that occurs during the processing of the exposed paper. In order for the hardening reaction to achieve the desired level of emulsion hardening, a certain amount of water in the emulsion layer is necessary to aid in the crosslinking process. By providing a layer between the emulsion and the paper base that has a lower rate of moisture transmission than that of polyethylene, the hardening reaction rate is increased because there is more available moisture in the emulsion for a longer period of time. A moisture vapor barrier on the backside of the paper is necessary because the product is in roll form during manufacturing and the emulsion is in contact with the backside. While providing one improved barrier layer for water vapor will provide for increased hardness, having barriers on both sides in a wound roll will provide for even greater benefits.

The exchange of moisture between the emulsion and the paper base occurs in a vapor form. The polyethylene layers have a certain amount of resistance to the vapor passing through their structure. Polymers are rated for their water vapor transmission rate. This is quantified as a certain amount of vapor per unit area over a certain time interval. Typical values are commonly expressed in terms of $g/mm^2/day$. The amount of vapor transmission can be affected by the amount or thickness of the polymer as well as the density and amount of crystallinity of the polymer. Typical values of water vapor transmission rate for the thickness of polyethylene that is used in photographic papers is about $1.6\times10^{-5}$ $g/mm^2/day$. Water vapor transmission is measured by ASTM Standard Method F1249.

Through this invention it has been shown that by selecting materials that have lower water vapor transmission rates than that of polyethylene or pigmented polyethylene, the rate of hardening and the ultimate hardness of an emulsion layer can be improved dramatically. The utility of this invention is that with faster hardening emulsions, the coated product can be slit and cut into final product format sooner because the emulsion is harder and more resistant to scratches and abrasions. This results in lower inventory levels and quicker flow of product throughout the manufacturing process. Furthermore by reducing the rate of moisture exchange between the paper base and the emulsion layer, there is less need for high moisture levels in the paper base. This has some advantages in the manufacturing process because high moisture levels in the paper base can create numerous problems with unevenness in the paper structure during the calendering process which can result in out of specification paper. Typical problems are ridges, poor roll condition, baggy edges, and variation in surface smoothness. Excessively high levels of moisture in the paper can result in crushing of the paper structure during calendering. The surface appearance of the paper becomes uneven and is often referred to as having a galvanized or differential gloss appearance. These problems add to the cost of paper and creates other complexities in trying to keep the moisture level high in the paper when the surrounding environmental conditions are such that the driving force is to remove moisture from the paper. During manufacturing this is important because the photographic base is in roll form and the edges of the paper are exposed to the environment without any polymer layer to slow the rate of moisture loss from the edge of the roll. This can result in the edges of the paper web being at a different moisture level than the center of the web. Since the hardening reaction is controlled by the amount of moisture, and if there is a differential moisture profile across the roll then the product performance can be different from the edge to the center. In the art of photographic paper manufacturing the loss of moisture from the edges is minimized by wrapping rolls with special and expensive wrapping or in some case the edges may have to be trimmed off and treated as waste. This adds cost to the product. An advantage of this invention is the elimination for the need to wrap rolls and the need to trim the edges for moisture profile related problems because the layer with improved resistance to water vapor transmission makes the emulsion and paper base substantially less susceptible to edge related problems. In addition if the final hardness or hardness at customer usage is higher than standard photographic products, there is more resistance to scratching and abrasion. Harder emulsion surfaces are also less tacky and will have reduced print sticking when prints are stacked and then separated. Less tacky surfaces also have the added advantage of less tendency to pickup dirt. In the photographic paper industry there is also a problem with core set and humidity induced curl. Core set curl is a temporary deformation of the photographic element that is characterized by a lack of flatness after the element is unwound from a storage core. The slow plastic deformation (or creep) of the materials in the element cause the element to assume the shape of the storage core. This non-flatness can cause usage problems for the photofinisher. It has been found that the raw base creep can be accelerated when exposed to changes in base humidity. Storage conditions for the photographic element on cores is often at either low or high humidities so the paper element near the core will undergo a moisture change relative to the rest of the element in the roll. This causes more extreme core set curl. A more effective moisture barrier that isolates the raw base from moisture changes at the core will reduce the core set curl significantly. These and other objects of the invention will be apparent from the details below.

The terms as used herein, "top", "upper", "emulsion side", and "face" mean the side or towards the of a photographic member bearing the imaging layers. The terms "bottom", "lower side", and "back" mean the side or towards the side of the photographic member opposite from the side bearing the photosensitive imaging layers or developed image.

Any suitable biaxially oriented polyolefin sheet may be used for the sheet on the top side of the laminated base of the invention. Microvoided composite biaxially oriented sheets are preferred and are conveniently manufactured by coextrusion of the core and surface layers, followed by biaxial orientation, whereby voids are formed around void-initiating material contained in the core layer. Such composite sheets are disclosed in, for example, U.S. Pat. Nos. 4,377,616; 4,758,462; and 4,632,869, the disclosure of which is incorporated by reference.

The core of the preferred composite sheet should be from 15 to 95% of the total thickness of the sheet, preferably from 30 to 85% of the total thickness. The nonvoided skins should thus total from 5 to 85% of the sheet, preferably from 15 to 70% of the thickness.

The density (specific gravity) of the composite sheet, expressed in terms of "percent of solid density" is calculated as follows:

Composite Sheet Density×100=% of Solid Density
Polymer Density

Percent solid density should be between 45% and 100%, preferably between 67% and 100%. As the percent solid density becomes less than 67%, the composite sheet becomes less manufacturable due to a drop in tensile strength and it becomes more susceptible to physical damage.

The total thickness of the composite sheet can range from 12 to 100 micrometers, preferably from 20 to 70 micrometers. Below 20 micrometers, the microvoided sheets may not be thick enough to minimize any inherent nonplanarity in the support and would be more difficult to manufacture. At thicknesses higher than 70 micrometers, little improvement in either surface smoothness or mechanical properties are seen, and so there is little justification for the further increase in cost for extra materials.

The biaxially oriented sheets of the invention preferably have a water vapor permeability that is less than $0.85\times10^{-5}$ g/mm$^2$/day. For water vapor transmission rates greater than $0.85\times10^{-5}$ g/mm$^2$/day, the advantages of a low water vapor transmission rate such as emulsion hardening are not significant.

In said photographic or imaging element, the water vapor barrier can be achieved by integrally forming said vapor barrier by coextrusion of the polymer(s) into at least one or more layers and then orienting the sheet by stretching it in the machine direction and then the cross direction. The process of stretching creates a sheet that is more crystalline and has better packing or alignment of the crystalline areas. Higher levels of crystallinity results in lower water vapor transmissions rates which in turn results in faster emulsion hardening. The oriented sheet is then laminated to a paper base.

The control of water vapor transmission can be provided by any layer independently such as the tie layer or the biaxially oriented polyolefin sheet or in combination with each other. With the incorporation of other layer(s) that are integrally formed with, applied to or bonded with the polyolefin sheet, the water vapor transmission rate can be adjusted to achieve the desired photographic or imaging results. One or more of the layers comprising the polyolefin sheet tie layer combinations may contain $TiO_2$ or other inorganic pigment In addition one or more of the layers comprising the polyolefin sheet may be voided. Other materials that can be used to enhance the water vapor transmission characteristics comprise at least one material from the group consisting of polyethylene terephthalate, polybutylterephthalate, acetates, cellophane polycarbonates, polyethylene vinyl acetate, ethylene vinyl acetate, methacrylate, polyethylene methylacrylate, acrylates, acrylonitrile, polyester ketone, polyethylene acrylic acid, polychlorotrifluoroethylene, polychlorotrifluoroethylene, polytetrafluoroethylene, amorphous nylon, polyhydroxyamide ether, and metal salt of ethylene methacrylic acid copolymers.

Another method of reducing the water vapor transmission rate of a biaxially oriented sheet is to coat a layer of material that has been dispersed or mixed in either an organic or aqueous solvent by any method known in the art such as roller, gravure, curtain, or bead coating. In the production of a suitable layer having low moisture transmission rates, preferably hydrophobic water-insoluble synthetic polymers are used. Said polymers are applied as a coating from a solution in an organic solvent or mixture of solvents. Preferred examples of such polymers include addition-type polymers and interpolymers prepared from ethylenically unsaturated monomers which include acrylates and methacrylates such as methyl acrylate, ethyl acrylate, butyl acrylate, hexyl acrylate, n-octyl acrylate, 2-ethylhexyl acrylate, nonyl acrylate, benzyl acrylate, lauryl acrylate, methyl methacrylate, ethyl methacrylate, butyl methcrylate, hexyl methacrylate, n-octyl methacrylate, 2-ethylhexyl methacrylate, nonyl methacrylate, benzyl methacrylate, lauryl methacrylate, dialkyl itaconates, dialkyl maleates, acrylonitrile and methacrylonitrile, styrenes including substituted styrenes, vinyl acetates, vinyl ethers, vinyl and vinylidene halides, and olefins such as butadiene and isoprene. Other polymers that may be effectively employed for the purpose of the present invention include organic solvent soluble condensation polymers such as cellulose derivatives, including cellulose nitrate, cellulose acetate, cellulose acetate proprionate, cellulose acetate butyrate, and the like, polycarbonates, polyurethanes, polyesters, epoxies, and polyamides.

A second means to achieve the desired water vapor transmission rate is the use of hydrophobic polymers coated on the biaxially oriented sheet from an aqueous dispersion or latex by any method known in the art. Preferred examples of particularly suitable aqueous dispersions include water dispersible polyurethanes and polyesters. Examples of suitable latex polymers include addition-type polymers and interpolymers prepared from the above mentioned ethylenically unsaturated monomers. The latex polymers may be prepared by conventional emulsion polymerization methods. The latex polymers may be core-shell polymers as described in U.S. Pat. No. 4,497,917, the disclosure of which is incorporated by reference.

The hydrophobic polymers which are applied from organic solvent or aqueous media may contain reactive functional groups capable of forming covalent bonds by intermolecular crosslinking or by reaction with a crosslinking agent (i.e., a hardener). Suitable reactive functional groups include hydroxyl, carboxyl, carbodiimide, amino, amide, allyl, epoxide, aziridine, vinyl sulfone, sulfinic acid, and active methylene.

Said material can be selected and coated or otherwise applied to the sheet in an amount to provide the desired water vapor barrier by itself or in combination with said biaxially oriented sheet and or tie layer that is used to adhere said sheet to the paper base. The preferred material is a biaxially oriented polyolefin sheet that is coated with high barrier polyvinylidene chloride in a range of coverage 1.5 to 6.2 g/m$^2$. Polyvinyl alcohol can also be used but is less effective under high relative humidity conditions. Through the use of at least one of these materials in combination with a biaxially oriented sheet and a polymer tie layer, it has been shown that improved rates of emulsion hardening can be achieved.

A barrier layer to control the rate of water vapor transmission can also be achieved by the use of a metal foil layer laminated to a paper base or metallized layer(s) coated or otherwise applied to the biaxially oriented sheet which is then laminated to the paper base. The sheets of metal foil can be attached to the paper base with the use of a melt polymer or adhesive coating. In the case in which the metal layer(s) are applied under the photo sensitive or imaging layer(s), a layer or polyethylene was applied to provide for better adhesion of the photo imaging layer to the base. In the case in which the metallized layer is incorporated with the biaxially oriented sheet of polypropylene, the metallized layer is vacuum deposited on the biaxially oriented sheet. A tie layer of melt polymer or coated adhesive is used to attach said sheet to the paper base. The metal or metallized layer can comprise at least one material from the following list of aluminum, nickel, steel, gold, zinc, copper, titanium, metallic alloys as well as inorganic compounds such as silicon oxides, silicon nitrides, aluminum oxides or titanium oxides. The preferred material comprises a vacuum deposited layer of aluminum and one or more layers of polyolefin which have been adhered to a paper base with a layer of polyolefin that has a water vapor transmission rate of less than $0.85\times 10^{-5}$ g/mm$^2$/day. The prior art for use of a metallized layer with films of polypropylene and coating of other substances to control water vapor transmission is noted in U.S. Pat. No. 5,192,620. The indicated use is for packaging applications.

As a method to further enhance the desired water vapor transmission rate,in combination with biaxially oriented sheets, is to saturate, impregnate or coat the paper base with polymers to reduce the water vapor transmission rate. The preferred method is to use this in combination with other polymer layers or to incorporate synthetic or modified fibers in the paper base that reduce the water vapor transmission properties. This combination allows more latitude in the design of the product. According to a first embodiment said polymers are applied from a solution in an organic solvent or mixture of solvents. Examples of such polymers include addition-type polymers and interpolymers prepared from ethylenically unsaturated monomers which include acrylates and methacrylates such as methyl acrylate, ethyl acrylate, butyl acrylate, hexyl acrylate, n-octyl acrylate, 2-ethylhexyl acrylate, nonyl acrylate, benzyl acrylate, lauryl acrylate, methyl methacrylate, ethyl methacrylate, butyl methcrylate, hexyl methacrylate, n-octyl methacrylate, 2-ethylhexyl methacrylate, nonyl methacrylate, benzyl methacrylate, lauryl methacrylate, diallyl itaconates, dialkyl maleates, acrylonitrile and methacrylonitrile, styrenes including substituted styrenes, vinyl acetates, vinyl ethers, vinyl and vinylidene halides, and olefins such as butadiene and isoprene. Other polymers that may be effectively employed for the purpose of the present invention include organic solvent soluble condensation polymers such as cellulose derivatives, including cellulose nitrate, cellulose acetate, cellulose acetate proprionate, cellulose acetate butyrate, and the like, polycarbonates, polyurethanes, polyesters, epoxies, and polyamides.

According to a second embodiment the hydrophobic polymers are coated from an aqueous dispersion or latex. Examples of particularly suitable aqueous dispersions include water dispersible polyurethanes and polyesters. Examples of suitable latex polymers include addition-type polymers and interpolymers prepared from the above mentioned ethylenically unsaturated monomers. The latex polymers may be prepared by conventional emulsion polymerization methods. The latex polymers may be core-shell polymers as described in U.S. Pat. No. 4,497,917, the disclosure of which is incorporated by reference.

The hydrophobic polymers which are applied from organic solvent or aqueous media may contain reactive functional groups capable of forming covalent bonds by intermolecular crosslinking or by reaction with a crosslinking agent (i.e., a hardener). Suitable reactive functional groups include hydroxyl, carboxyl, carbodiimide, amino, amide, allyl, epoxide, aziridine, vinyl sulfone, sulfinic acid, active methylene, and the like.

A further means to enhance the desired water vapor transmission rate, in combination with biaxially oriented sheet, is to incorporate plastic fibers, pigments or modified cellulose fibers within the paper base.

The biaxially oriented sheet of this invention may be a voided sheet.

The term "Void" is used herein to mean devoid of added solid and liquid matter, although it is likely the "voids" contain gas. The void-initiating particles which remain in the finished packaging sheet core should be from 0.1 to 10 micrometers in diameter, preferably round in shape, to produce voids of the desired shape and size. The size of the void is also dependent on the degree of orientation in the machine and transverse directions. Ideally, the void would assume a shape which is defined by two opposed and edge contacting concave disks. In other words, the voids tend to have a lens-like or biconvex shape. The voids are oriented so that the two major dimensions are aligned with the machine and transverse directions of the sheet. The Z-direction axis is a minor dimension and is roughly the size of the cross diameter of the voiding particle. The voids generally tend to be closed cells, and thus there is virtually no path open from one side of the voided-core to the other side through which gas or liquid can traverse.

The void-initiating material may be selected from a variety of materials, and should be present in an amount of about 5 to 50% by weight based on the weight of the core matrix polymer. Preferably, the void-initiating material comprises a polymeric material. When a polymeric material is used, it may be a polymer that can be melt-mixed with the polymer from which the core matrix is made and be able to form dispersed spherical particles as the suspension is cooled down. Examples of this would include nylon dispersed in polypropylene, polybutylene terephthalate in polypropylene, or polypropylene dispersed in polyethylene terephthalate. If the polymer is preshaped and blended into the matrix polymer, the important characteristic is the size and shape of the particles. Spheres are preferred and they can be hollow or solid. These spheres may be made from cross-like polymers which are members selected from the group consisting of an alkenyl aromatic compound having the general formula Ar—C(R)=$CH_2$, wherein Ar represents an aromatic hydrocarbon radical, or an aromatic halohydrocarbon radical of the benzene series and R is hydrogen or the methyl radical; acrylate-type monomers include monomers of the formula $CH_2$=C(R')—C(O)(OR) wherein R is selected from the group consisting of hydrogen and an alkyl radical containing from about 1 to 12 carbon atoms and R' is selected from the group consisting of hydrogen and methyl; copolymers of vinyl chloride and vinylidene chloride, acrylonitrile and vinyl chloride, vinyl bromide, vinyl esters having formula $CH_2$=CH(O)COR, wherein R is an alkyl radical containing from 2 to 18 carbon atoms; acrylic acid, methacrylic acid, itaconic acid, citraconic acid, maleic acid, flumaric acid, oleic acid, vinylbenzoic acid; the synthetic polyester resins which are prepared by reacting terephthalic acid and dialkyl terephthalics or ester-forming derivatives thereof, with a glycol of the series $HO(CH_2)_nOH$ wherein n is a whole number within the range of 2–10 and having reactive olefinic linkages within the polymer molecule, the above described polyesters which include copolymerized therein up to 20 percent by weight of a second acid or ester thereof having reactive olefnic unsaturation and mixtures thereof, and a cross-lining agent selected from the group consisting of divinylbenzene, diethylene glycol dimethacrylate, diallyl fumarate, diallyl phthalate and mixtures thereof.

Examples of typical monomers for making the crosslinked polymer include styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, acrylamidomethyl-propane sulfonic acid, vinyl toluene, etc. Preferably, the cross-linked polymer is polystyrene or poly(methyl methacrylate). Most preferably, it is polystyrene and the cross-linking agent is divinylbenzene.

Processes well known in the art yield non-uniformly sized particles, characterized by broad particle size distributions. The resulting beads can be classified by screening the beads spanning the range of the original distribution of sizes. Other processes such as suspension polymerization, limited coalescence, directly yield very uniformly sized particles.

The void-initiating materials may be coated with agents to facilitate voiding. Suitable agents or lubricants include colloidal silica, colloidal alumina, and metal oxides such as tin oxide and aluminum oxide. The preferred agents are colloidal silica and alumina, most preferably, silica The cross-linked polymer having a coating of an agent may be prepared by procedures well known in the art For example, conventional suspension polymerization processes wherein the agent is added to the suspension is preferred. As the agent, colloidal silica is preferred.

The void-initiating particles can also be inorganic spheres, including solid or hollow glass spheres, metal or ceramic beads or inorganic particles such as clay, talc, barium sulfate, calcium carbonate. The important thing is that the material does not chemically react with the core matrix polymer to cause one or more of the following problems: (a) alteration of the crystallization kinetics of the matrix polymer, making it difficult to orient, (b) destruction of the core matrix polymer, (c) destruction of the void-initiating particles, (d) adhesion of the void-initiating particles to the matrix polymer, or (e) generation of undesirable reaction products, such as toxic or high color moieties. The void-initiating material should not be photographically active or degrade the performance of the photographic element in which the biaxially oriented polyolefin sheet is utilized.

For the biaxially oriented sheet on the top side toward the emulsion, suitable classes of thermoplastic polymers for the biaxially oriented sheet and the core matrix-polymer of the preferred composite sheet comprise polyolefins.

Suitable polyolefins include polypropylene, polyethylene, polymethylpentene, polystyrene, polybutylene and mixtures thereof. Polyolefin copolymers, including copolymers of propylene and ethylene such as hexene, butene, and octene are also useful. Polypropylene is preferred, as it is low in cost, has desirable strength properties and is low in water vapor transmission.

The nonvoided skin layers of the composite sheet can be made of the same polymeric materials as listed above for the core matrix The composite sheet can be made with skin(s) of the same polymeric material as the core matrix, or it can be made with skin(s) of different polymeric composition than the core matrix. For compatibility, an auxiliary layer can be used to promote adhesion of the skin layer to the core.

Addenda may be added to the core matrix and/or to the skins to improve the whiteness of these sheets. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the sheet or the manufacturability of the sheet. For photographic use, a white base with a slight bluish tint is preferred.

The coextrusion, quenching, orienting, and heat setting of these composite sheets may be effected by any process which is known in the art for producing oriented sheet, such as by a flat sheet process or a bubble or tubular process. The flat sheet process involves extruding the blend through a slit die and rapidly quenching the extruded web upon a chilled casting drum so that the core matrix polymer component of the sheet and the skin components(s) are quenched below their glass solidification temperature. The quenched sheet is then biaxially oriented by stretching in mutually perpendicular directions at a temperature above the glass transition temperature, below the melting temperature of the matrix polymers. The sheet may be stretched in one direction and then in a second direction or may be simultaneously stretched in both directions. After the sheet has been stretched, it is heat set by heating to a temperature sufficient to crystallize or anneal the polymers while restraining to some degree the sheet against retraction in both directions of stretching.

The composite sheet, while described as having preferably at least three layers of a microvoided core and a skin layer on each side, may also be provided with additional layers that may serve to change the properties of the biaxially oriented sheet. A different effect may be achieved by additional layers. Such layers might contain tints, antistatic materials, or different void-making materials to produce sheets of unique properties. Biaxially oriented sheets could be formed with surface layers that would provide an improved adhesion, or look to the support and photographic element. The biaxialy oriented extrusion could be carried out with as many as 10 layers if desired to achieve some particular desired property.

These composite sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photo sensitive layers. Examples of this would be acrylic coatings for printability, coating polyvinylidene chloride for heat seal properties. Further examples include flame, plasma or corona discharge treatment to improve printability or adhesion.

By having at least one nonvoided skin on the microvoided core, the tensile strength of the sheet is increased and makes it more manufacturable. It allows the sheets to be made at wider widths and higher draw ratios than when sheets are made with all layers voided. Coextruding the layers further simplifies the manufacturing process.

The structure of a typical biaxially oriented, microvoided sheet of the invention is as follows:

| |
|---|
| solid skin layer |
| microvoided core layer |
| solid skin layer |

The sheet on the lower side of the base paper opposite to the emulsion layers may be any suitable sheet The sheet may or may not be microvoided. It may have the same composition as the sheet on the top side of the paper backing material. Biaxially oriented sheets are conveniently manufactured by coextrusion of the sheet, which may contain several layers, followed by biaxial orientation. Such biaxially oriented sheets are disclosed in, for example, U.S. Pat No. 4,764,425, the disclosure of which is incorporated for reference.

The preferred biaxially oriented sheet is a biaxially oriented polyolefin sheet, most preferably a sheet of polyethylene or polypropylene. The thickness of the biaxially oriented sheet should be from 10 to 150 microns. Below 15 microns, the sheets may not be thick enough to minimize any inherent non-planarity in the support and would be more difficult to manufacture. At thicknesses higher than 70 micrometers, little improvement in either surface smoothness or mechanical properties are seen, and so there is little justification for the further increase in cost for extra materials.

Suitable classes of thermoplastic polymers for the biaxially oriented sheet include polyolefins, polyesters, polyamides, polycarbonates, cellulosic esters, polystyrene, polyvinyl resins, polysulfonamides, polyethers, polyimides, polyvinylidene fluoride, polyurethanes, polyphenylenesulfides, polytetrafluoroethylene, polyacetals, polysulfonates, polyester ionomers, and polyolefin ionomers. Copolymers and/or mixtures of these polymers can be used.

Suitable polyolefins include polypropylene, polyethylene, polymethylpentene, and mixtures thereof. Polyolefin copolymers, including copolymers of propylene and ethylene such as hexene, butene and octene are also useful. Polypropylenes are preferred because they are low in cost and have good strength and surface properties.

Suitable polyesters include those produced from aromatic, aliphatic or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexanedicar-boxylic, sodiosulfoisophthalic, and mixtures thereof. Examples of suitable glycols include ethylene glycol, propylene glycol, butanediol, pentanediol, hexanediol, 1,4-cyclohexanedimethanol, diethylene glycol, other polyethylene glycols and mix thereof. Such polyesters are well known in the art and may be produced by wellknown techniques, e.g., those described in U.S. Pat. Nos. 2,465,319 and 2,901,466. Preferred continuous matrix polyesters are those having repeat units from terephthalic acid or naphthalene dicarboxylic acid and at least one glycol selected from ethylene glycol, 1,4-butanediol and 1,4-cyclohexanedimethanol. Poly (ethylene terephthalate), which may be modified by small amounts of other monomers, is especially preferred. Other suitable polyesters include liquid crystal copolyesters formed by the inclusion of suitable amount of a co-acid component such as stilbene dicarboxylic acid. Examples of such liquid crystal copolyesters are those disclosed in U.S. Pat. Nos. 4,420,607; 4,459,402; and 4,468,510.

Useful polyamides include nylon 6, nylon 66, and mixtures thereof. Copolymers of polyamides are also suitable continuous phase polymers. An example of a useful polycarbonate is bisphenol-A polycarbonate. Cellulosic esters suitable for use as the continuous phase polymer of the composite sheets include cellulose nitrate, cellulose triacetate, cellulose diacetate, cellulose acetate propionate, cellulose acetate butyrate, and mixtures or copolymers thereof. Useful polyvinyl resins include polyvinyl chloride, poly(vinyl acetal), and mixtures thereof. Copolymers of vinyl resins can also be utilized.

The biaxially oriented sheet on the back side of the laminated base can be made with layers of the same polymeric material, or it can be made with layers of different polymeric composition. For compatibility, an auxiliary layer can be used to promote adhesion of multiple layers.

Addenda may be added to the biaxially oriented back side sheet to improve the whiteness of these sheets. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the sheet or the manufacturability of the sheet.

The coextrusion, quenching, orienting, and heat setting of these biaxially oriented sheets may be effected by any process which is known in the art for producing oriented sheet, such as by a flat sheet process or a bubble or tubular process. The flat sheet process involves extruding or coextruding the blend through a slit die and rapidly quenching the extruded or coextruded web upon a chilled casting drum so that the polymer component(s) of the sheet are quenched below their solidification temperature. The quenched sheet is then biaxially oriented by stretching in mutually perpendicular directions at a temperature above the glass transition temperature of the polymer(s). The sheet may be stretched in one direction and then in a second direction or may be simultaneously stretched in both directions. After the sheet has been stretched, it is heat set by heating to a temperature sufficient to crystallize the polymers while restraining to some degree the sheet against retraction in both directions of stretching.

The biaxially oriented sheet on the back side of the laminated base, while described as having preferably at least one layer, may also be provided with additional layers that may serve to change the properties of the biaxially oriented sheet. A different effect may be achieved by additional layers. Such layers might contain tints, antistatic materials, or slip agents to produce sheets of unique properties. Biaxially oriented sheets could be formed with surface layers that would provide an improved adhesion, or look to the support and photographic element. The biaxially oriented extrusion could be carried out with as many as 10 layers if desired to achieve some particular desired property.

These biaxially oriented sheets on the back side of the laminated base may be coated or treated after the coextrusion and orienting process or between casting and full orientation with any number of coatings which may be used to improve the properties of the sheets including printability, to provide additional water vapor barrier protection, to make them heat sealable, or to improve the adhesion to the support or to the photo sensitive layers. Examples of this would be acrylic coatings for printability, coating polyvinylidene chloride for heat seal properties. Further examples include flame, plasma or corona discharge treatment to improve printability or adhesion.

The structure of a typical biaxially oriented sheet to be laminated on the side opposite the imaging element is as follows:

| |
|---|
| Paper Base |
| Solid Core Layer |
| Treated skin layer |

The support to which the microvoided composite sheets and biaxially oriented sheets are laminated for the laminated support of the photosensitive silver halide layer may be a polymeric, a synthetic paper, cloth, woven polymer fibers, or a cellulose fiber paper support, or laminates thereof. The base also may be a microvoided polyethylene terephalate such as disclosed in U.S. Pat. Nos. 4,912,333; 4,994,312 and 5,055,371, the disclosure of which is incorporated by reference.

In the art of paper making there are also ways to make paper less sensitive to water vapor transmission by either impregnating or coating said sheet with a variety of polyermic materials. In the production of a suitable layer having low moisture transmission rates, preferably hydrophobic water-insoluble synthetic polymers are used. U.S. Pat. No. 5,290,671 refers to the impregnation of photographic paper with a substance to lower the oxygen transmission rate for dye fade improvements. The advantage of combining a paper base sheet with low water vapor transmission properties with a biaxially oriented polyolefin sheet is that the combined properties for water vapor transmission allow a wider choice of less costly materials.

The preferred support is a photographic grade cellulose fiber paper. When using a cellulose fiber paper support, it is preferable to extrusion laminate the microvoided composite sheets to the base paper using a polyolefin resin. Extrusion laminating is carried out by bringing together the biaxially oriented sheets of the invention and the base paper with application of an adhesive between them followed by their being pressed in a nip such as between two rollers. The adhesive may be applied to either the biaxially oriented sheets or the base paper prior to their being brought into the nip. In a preferred form the adhesive is applied into the nip simultaneously with the biaxially oriented sheets and the base paper. The adhesive may be any suitable material that does not have a harmful effect upon the photographic element. A preferred material is polyethylene that is melted at the time it is placed into the nip between the paper and the biaxially oriented sheet.

During the lamination process, it is desirable to maintain control of the tension of the biaxially oriented sheet(s) in order to minimize curl in the resulting laminated support. For high humidity applications (>50% RH) and low humidity applications (<20% RH), it is desirable to laminate both a front side and back side film to keep curl to a minimum.

In one preferred embodiment, in order to produce photographic elements with a desirable photographic look and feel, it is preferable to use relatively thick paper supports (e.g., at least 120 mm thick, preferably from 120 to 250 mm thick) and relatively thin microvoided composite sheets (e.g., less than 50 mm thick, preferably from 20 to 50 mm thick, more preferably from 30 to 50 mm thick).

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

The photographic emulsions useful for this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support Various coating techniques include dip coating, air knife coating, curtain coating and extrusion coating.

The silver halide emulsions utilized in this invention may be comprised of any halide distribution. Thus, they may be comprised of silver chloride, silver chloroiodide, silver bromide, silver bromochloride, silver chlorobromide, silver iodochloride, silver iodobromide, silver bromoiodochloride, silver chloroiodobromide, silver iodobromochloride, and silver iodochlorobromide emulsions. It is preferred, however, that the emulsions be predominantly silver chloride emulsions. By predominantly silver chloride, it is meant that the grains of the emulsion are greater than about 50 mole percent silver chloride. Preferably, they are greater than about 90 mole percent silver chloride; and optimally greater than about 95 mole percent silver chloride.

The silver halide emulsions can contain grains of any size and morphology. Thus, the grains may take the form of cubes, octahedrons, cubooctahedrons, or any of the other naturally occurring morphologies of cubic lattice type silver halide grains. Further, the grains may be irregular such as spherical grains or tabular grains. Grains having a tabular or cubic morphology are preferred.

The photographic elements of the invention may utilize emulsions as described in *The Theory of the Photographic Process*, Fourth Edition, T. H. James, Macmillan Publishing Company, Inc., 1977, pages 151–152. Reduction sensitization has been known to improve the photographic sensitivity of silver halide emulsions. While reduction sensitized silver halide emulsions generally exhibit good photographic speed, they often suffer from undesirable fog and poor storage stability.

Reduction sensitization can be performed intentionally by adding reduction sensitizers, chemicals which reduce silver ions to form metallic silver atoms, or by providing a reducing environment such as high pH (excess hydroxide ion) and/or low pAg (excess silver ion). During precipitation of a silver halide emulsion, unintentional reduction sensitization can occur when, for example, silver nitrate or alkali solutions are added rapidly or with poor mixing to form emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectral/chemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11) and low pAg (pAg 1–7) ripening are discussed by S.Collier in Photographic Science and Engineering, 23,113 (1979). Examples of processes for preparing intentionally reduction sensitized silver halide emulsions are described in EP 0 348934 A1 (Yamashita), EP 0 369491 (Yamashita), EP 0 371388

(Ohashi), EP 0 396424 A1 (Takada), EP 0 404142 A1 (Yamada), and EP 0 435355 A1 (Makino).

The photographic elements of this invention may use emulsions doped with Group VIII metals such as iridium, rhodium, osmium, and iron as described in *Research Disclosure*, September 1996, Item 38957, Section I, published by Kenneth Mason Publications, Ltd., Dudley Annex, 12a North Street, Emsworth, Hampshire PO10 7DQ, ENGLAND. Additionally, a general summary of the use of iridium in the sensitization of silver halide emulsions is contained in Carroll, "Iridium Sensitization: A Literature Review," Photographic Science and Engineering, Vol. 24, No. 6, 1980. A method of manufacturing a silver halide emulsion by chemically sensitizing the emulsion in the presence of an iridium salt and a photographic spectral sensitizing dye is described in U.S. Pat. No. 4,693,965. In some cases, when such dopants are incorporated, emulsions show an increased fresh fog and a lower contrast sensitometric curve when processed in the color reversal E-6 process as described in The British Journal of Photography Annual, 1982, pages 201–203.

A typical multicolor photographic element of the invention comprises the invention laminated support bearing a cyan dye image-forming unit comprising at least one red-sensitive silver halide emulsion layer having associated therewith at least one cyan dye-forming coupler, a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like. The support of the invention may also be utilized for black and white photographic print elements.

The photographic elements may also contain a transparent magnetic recording layer such as a layer containing magnetic particles on the underside of a transparent support, as in U.S. Pat. No. 4,279,945 and 4,302,523. Typically, the element will have a total thickness (excluding the support) of from about 5 to about 30 microns.

In the following Table, reference will be made to (1) *Research Disclosure*, December 1978, Item 17643, (2) *Research Disclosure*, December 1989, Item 308119, and (3) *Research Disclosure*, September 1996, Item 38957, all published by Kenneth Mason Publications, Ltd., Dudley Annex, 12a North Street, Emsworth, Hampshire PO10 7DQ, ENGLAND. The Table and the references cited in the Table are to be read as describing particular components suitable for use in the elements of the invention. The Table and its cited references also describe suitable ways of preparing, exposing, processing and manipulating the elements, and the images contained therein.

| Reference | Section | Subject Matter |
|---|---|---|
| 1 | I, II | Grain composition, |
| 2 | I, II, IX, X, XI, XII, XIV, XV | morphology and preparation. Emulsion preparation including |
| 3 | I, II, III, IX A & B | hardeners, coating aids, addenda, etc. |
| 1 | III, IV | Chemical sensitization and |
| 2 | III, IV | spectral sensitization/ |
| 3 | IV, V | desensitization |
| 1 | V | UV dyes, optical |

-continued

| Reference | Section | Subject Matter |
|---|---|---|
| 2 | V | brighteners, luminescent |
| 3 | VI | dyes |
| 1 | VI | Antifoggants and stabilizers |
| 2 | VI | |
| 3 | VII | |
| 1 | VIII | Absorbing and scattering |
| 2 | VIII, XIII, XVI | materials; Antistatic layers; matting agents |
| 3 | VIII, IX C & D | |
| 1 | VII | Image-couplers and image- |
| 2 | VII | modifying couplers; Dye |
| 3 | X | stabilizers and hue modifiers |
| 1 | XVII | Supports |
| 2 | XVII | |
| 3 | XV | |
| 3 | XI | Specific layer arrangements |
| 3 | XII, XIII | Negative working emulsions; Direct positive emulsions |
| 2 | XVIII | Exposure |
| 3 | XVI | |
| 1 | XIX, XX | Chemical processing; |
| 2 | XIX, XX, XXII | Developing agents |
| 3 | XVIII, XIX, XX | |
| 3 | XIV | Scanning and digital processing procedures |

The photographic elements can be exposed with various forms of energy which encompass the ultraviolet, visible, and infrared regions of the electromagnetic spectrum as well as with electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic elements.

The photographic elements are preferably exposed to actinic radiation, typically in the visible region of the spectrum, to form a latent image, and then processed to form a visible image, preferably by other than heat treatment. Processing is preferably carried out in the known RA-4™ (Eastman Kodak Company) Process or other processing systems suitable for developing high chloride emulsions.

The laminated substrate of the invention may have copy restriction features incorporated such as disclosed in U.S. patent application Ser. No. 08/598,785 filed Feb. 8, 1996 and U.S. application Ser. No. 08/598,778 filed on the same day. These applications disclose rendering a document copy restrictive by embedding into the document a pattern of invisible microdots. These microdots are, however, detectable by the electro-optical scanning device of a digital document copier. The pattern of microdots may be incorporated throughout the document. Such documents may also have colored edges or an invisible microdot pattern on the back side to enable users or machines to read and identify the media. The media may take the form of sheets that are capable of bearing an image. Typical of such materials are photographic paper and film materials composed of polyethylene resin coated paper, polyester, (polyethylene naphthalate, and cellulose triacetate based materials.

The microdots can take any regular or irregular shape with a size smaller than the maximum size at which individual microdots are perceived sufficiently to decrease the usefulness of the image, and the minimum level is defined by the detection level of the scanning device. The microdots may be distributed in a regular or irregular array with center-to-center spacing controlled to avoid increases in document density. The microdots can be of any hue, brightness, and saturation that does not lead to sufficient detection by casual observation, but preferably of a hue least resolvable by the human eye, yet suitable to conform to the sensitivities of the document scanning device for optimal detection.

In one embodiment the information-bearing document is comprised of a support, an image-forming layer coated on the support and pattern of microdots positioned between the support and the image-forming layer to provide a copy restrictive medium. Incorporation of the microdot pattern into the document medium can be achieved by various printing technologies either before or after production of the original document. The microdots can be composed of any colored substance, although depending on the nature of the document, the colorants may be translucent, transparent, or opaque. It is preferred to locate the microdot pattern on the support layer prior to application of the protective layer, unless the protective layer contains light scattering pigments. Then the microdots should be located above such layers and preferably coated with a protective layer. The microdots can be composed of colorants chosen from image dyes and filter dyes known in the photographic art and dispersed in a binder or carrier used for printing inks or light-sensitive media.

In a preferred embodiment the creation of the microdot pattern as a latent image is possible through appropriate temporal, spatial, and spectral exposure of the photosensitive materials to visible or non-visible wavelengths of electromagnetic radiation. The latent image microdot pattern can be rendered detectable by employing standard photographic chemical processing. The microdots are particularly useful for both color and black-and-white image-forming photographic media. Such photographic media will contain at least one silver halide radiation sensitive layer, although typically such photographic media contain at least three silver halide radiation sensitive layers. It is also possible that such media contain more than one layer sensitive to the same region of radiation. The arrangement of the layers may take any of the forms known to one skilled in the art, as discussed in *Research Disclosure*37038 of February 1995.

Commercial Grade Paper of Examples

A photographic paper support was produced by refining a pulp furnish of 50% bleached hardwood kraft, 25% bleached hardwood sulfite, and 25% bleached softwood sulfite through a double disk refiner, then a Jordan conical refiner to a Canadian Standard Freeness of 200 cc. To the resulting pulp furnish was added 0.2% alkyl ketene dimer, 1.0% cationic cornstarch, 0.5% polyamideepichlorohydrin, 0.26 anionic polyacrylamide, and 5.0% $TiO_2$ on a dry weight basis. An about 46.5 lbs. per 1000 sq. ft. (ksf) bone dry weight base paper was made on a fourdrinier paper machine, wet pressed to a solid of 42%, and dried to a moisture of 10% using steam-heated dryers achieving a Sheffield Porosity of 160 Sheffield Units and an apparent density 0.70 g/cc. The paper base was then surface sized using a vertical size press with a 10% hydroxyethylated cornstarch solution to achieve a loading of 3.3 wt. % starch. The surface sized support was calendered to an apparent density of 1.04 gm/cc.

EXAMPLES 1

The following laminated photographic bases in Table 1 were prepared by extrusion laminating a biaxially oriented sheet to the emulsion side of photographic grade cellulose paper base and a biaxially oriented sheet to the back side of the photographic grade cellulose paper base. The following sheets were laminated:

Bottom Sheet: (back side)

Bicor 70 MLT (Mobil Chemical Company), a one side matte finish, one side treated biaxially oriented polypropylene sheet (18 mm thick) (d=0.9 g/cc) consisting of a solid oriented polypropylene core and a skin layer of a block copolymer of polyethylene and polypropylene. A tie layer of low density polyethylene with a density of 0.923 g/cm$^3$ and a melt index of 4.2 was melt extruded at 12 g/m$^2$ was used to adhere the oriented sheet to the paper base. The normalized water vapor transmission rate of the sheet was measured utilizing a MOCON unit (Manufactured by Modem Control, Inc.) at ASTM standards of 38° C. and 90% RH.

Face Side: (Side under the Photographic emulsion)

A biaxially oriented multi-layer sheet of polypropylene of 1.2 mils thickness containing a polyethylene skin layer, a layer with $TiO_2$ of approximately 15%, a cavitated polypropylene core and corresponding layer of clear solid polypropylene on the opposite side of the sheet was extrusion laminated to the other side of the 156 g/m$^2$ photographic cellulose raw stock using a tie layer of low density polyethylene with a density of 0.923 g/cm$^3$ and a melt index of 4.2 at 12 g/m$^2$ to adhere the oriented sheet to the paper base. The normalized water vapor transmission rate of the sheet was measured utilizing a MOCON unit (Manufactured by Modem Control, Inc.) at ASTM standards of 38° C. and 90% RH. The water vapor transmission rate of the biaxially oriented sheet and tie layer had a water vapor transmission rate (WVTR) of less than $0.85\times10^{-5}$ g/mm$^2$/day.

Control:

The standard 156 g/m$^2$ photographic cellulose raw stock was extrusion coated with a non-pigmented polyethylene with a density 0.929 g/cm$^3$ on the backside of 1.2 mils and with a layer of polyethylene with a density of 0.923 g/cm$^3$ containing approximately 15% $TiO_2$. The layer thickness was approximately 1.5 mils. The normalized water vapor transmission rate of the film was measured utilizing a MOCON unit (Manufactured by Modem Control, Inc.) at ASTM standards of 38° C. and 90% RH.

Conditioning:

The laminated base, as well as the control samples of resin coated paper, were slit to 12.5 cm such that the edges of the raw stock were exposed (free of any polymer) and the rolls were placed in a 20% RH and 50% RH conditioning room until the cross web moisture profile differential was near zero from edge to center and the laminated and resin coated rolls were at same moisture content. Samples rolls were check at the core, center, and outside to assure that the moisture profile was even throughout the entire roll. Once the moisture level was stabilized the rolls were placed in a special foil bags to preserve the moisture content within each roll.

Coating format 1 was utilized to prepare the silver halide emulsion coated samples used in this example.

| Coating Format 1 | Laydown mg/m$^2$ |
|---|---|
| Layer Blue Sensitive Layer | |
| Gelatin | 1300 |
| Blue sensitive silver | 200 |
| Y-1 | 440 |

-continued

| | |
|---|---|
| ST-1 | 440 |
| S-1 | 190 |
| Layer Interlayer | |
| Gelatin | 650 |
| SC-1 | 55 |
| S-1 | 160 |
| Layer Green Sensitive Layer | |
| Gelatin | 1100 |
| Green sensitive silver | 70 |
| M-1 | 270 |
| S-1 | 75 |
| S-2 | 32 |
| ST-2 | 20 |
| ST-3 | 165 |
| ST-4 | 530 |
| Layer UV Interlayer | |
| Gelatin | 635 |
| UV-1 | 30 |
| UV-2 | 160 |
| SC-1 | 50 |
| S-3 | 30 |
| S-1 | 30 |
| Layer Red Sensitive Layer | |
| Gelatin | 1200 |
| Red sensitive silver | 170 |
| C-1 | 365 |
| S-1 | 360 |
| UV-2 | 235 |
| S-4 | 30 |
| SC-1 | 3 |
| Layer UV Overcoat | |
| Gelatin | 440 |
| UV-1 | 20 |
| UV-2 | 110 |
| SC-1 | 30 |
| S-3 | 20 |
| S-1 | 20 |
| Layer SOC | |
| Gelatin | 490 |
| SC-1 | 17 |
| $SiO_2$ | 200 |
| Surfactant | 2 |

APPENDIX

Y-1

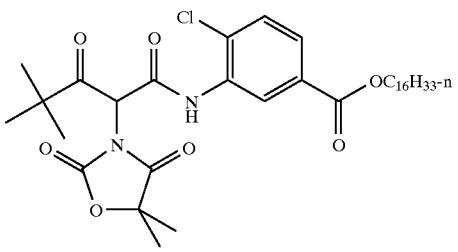

ST-1 = N-tert-butylacrylamide/n-butyl acrylate copolymer (50:50)
S-1 = dibutyl phthalate

SC-1

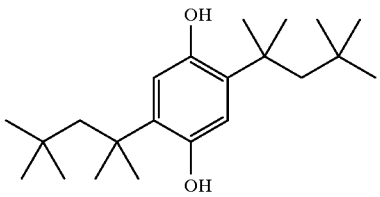

-continued

M-1

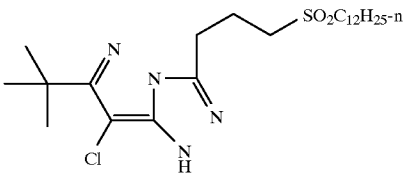

S-2 = diundecyl phthalate

ST-2

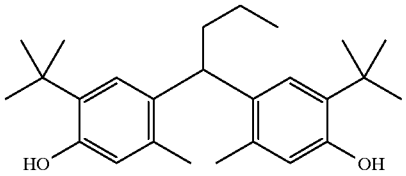

ST-3

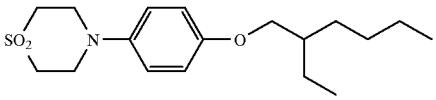

ST-4

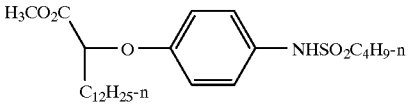

UV-1

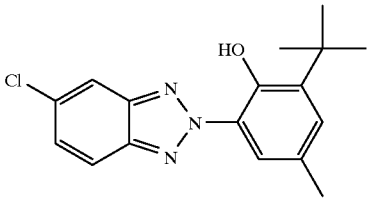

UV-2

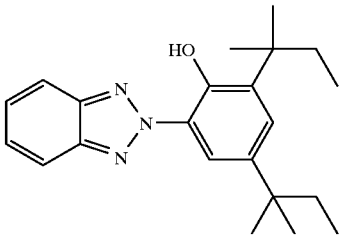

S-3 = 1,4-Cyclohexyldimethylene bis(2-ethylhexanoate)

C-1

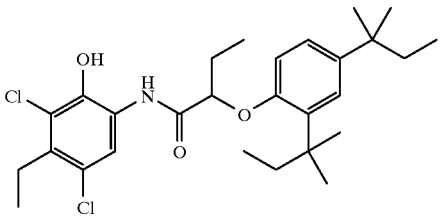

-continued

S-4 = 2-(2-Butoxyethoxy)ethyl acetate

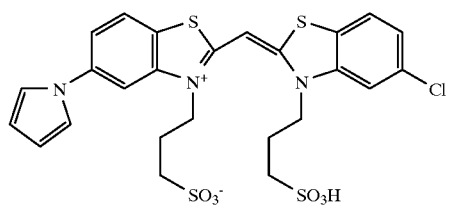

Dye 1

The above photographic emulsion was dried and conditioned to a moisture equilibrium standard to normal manufacturing and wound in roll form. The rolls were immediately placed in a foil bags and sealed. Samples were then tested over several weeks. The samples were then tested with a stylus instrument with varying weights by scribing the emulsion. The amount of force used to penetrated the emulsion layer is used as a measure of the hardness and is expressed in terms of grams. Another test that is used is a measure of the amount of water that the emulsion will pick up. This is measured by determining the amount of water pickup and is measured in milligrams per unit area. A sample of a standard dimension (929 $cm^2$) is cut and weighed and then placed in a beaker of distilled water at 20° C. for 5 minutes. The sample is then removed and the excess water is removed by placing the sample between Kimwipes on a glass plate. The sample is lightly rolled. The sample is then weighed again to determine the amount of water absorption.

These tests were repeated over a time interval of several days and were run with controls of polyethylene coated photographic paper as described above.

TABLE 1

| Sample ID | Construction | Base Conditioning |
|---|---|---|
| A | Laminated as above | 50% RH |
| B | Control | 50% RH |
| C | Laminated as above | 20% RH |
| D | Control | 20% RH |

TABLE 2

Initial and Rate of Hardening

| | WVTR | (grams to scribe) (Time Intervals- Days) | | | | | |
|---|---|---|---|---|---|---|---|
| Sample | (1.0 × $10^{-5}$g/$mm^2$/day) | Fresh | 1 | 5 | 7 | 14 | 28 |
| A | <0.85 | 10 | 17 | 24 | 27 | 28 | 30 |
| B(Control) | 16 | 3 | 9 | 12 | 17 | 18 | 21 |
| C | <0.85 | 4 | 9 | 12 | 16 | 17 | 18 |
| D(Control) | 16 | 2 | 2 | 3 | 7 | 8 | 10 |

The results from Table 1 clearly show that the samples with a lower water vapor transmission rate achieve a much harder emulsion surface than the control. The water vapor transmission rates are the combined effect of the biaxially oriented polypropylene sheet and tie layer because the area of concern is the rate of moisture exchange between the paper and the photographic emulsion.

The data in Table 2 not only show a higher rate of initial hardness, but also a higher rate and higher ultimate hardness for those samples with a lower water vapor transmission rate.

TABLE 3

Gravimetric Swell (amount of water pickup)

| | WVTR (1.0 × | (mg/929 $cm^2$) (Time Interval - Days) | | | | |
|---|---|---|---|---|---|---|
| Sample ID | $10^{-5}$ g/$mm^2$/day) | 1 | 3 | 7 | 14 | 28 (days) |
| A | <0.85 | 1850 | 1700 | 1650 | 1625 | 1600 |
| B (Control) | 16 | 2300 | 1900 | 1800 | 1750 | 1700 |
| C | <0.85 | 1525 | 1475 | 1425 | 1400 | 1400 |
| D (Control) | 16 | 1600 | 1590 | 1575 | 1500 | 1475 |

The data from this evaluation (Table 3) also show that with lower rates of water vapor transmission, the amount of water pickup is less than with standard product. This is an indication that emulsion has hardened more than the control samples.

The invention has been described in detail with particular reference to certain preferred embodiments thereof, but it will be understood that variations and modifications can be effected within the spirit and scope of the invention.

What is claimed is:

1. A photographic imaging element comprising a paper base, at least one photosensitive silver halide layer, a tie layer and a biaxially oriented polyolefin sheet wherein said polyolefin sheet by itself or in combination with said tie layer has a water vapor transmission rate of less than $0.85\times10^{-5}$ g/$mm^2$/day.

2. The photographic imaging element of claim 1 wherein biaxially oriented sheet has a water vapor barrier layer formed integrally with said oriented sheet.

3. The photographic imaging element of claim 1 wherein said tie layer is melt extruded in at least one layer.

4. The photographic imaging element of claim 3 wherein said tie layer provides all or part of the water vapor transmission rate.

5. The photographic imaging element of claim 1 wherein said polyolefin sheet and photosensitive silver halide member are on the top of said element and said element further comprises a biaxially oriented polymer sheet on the back of said element.

6. The photographic imaging element of claim 5 wherein said paper base comprises cellulose fiber paper.

7. The photographic imaging element of claim 5 wherein said biaxially oriented sheet comprises polypropylene.

8. The photographic imaging element of claim 2 wherein said barrier layer comprises at least one material selected from the group consisting of homo and copolymers of polypropylene, polyethylene and or polyesters.

9. The photographic imaging element of claim 1 wherein said barrier layer comprises at least one material selected from the group consisting of homo and copolymers of polypropylene, polyethylene and or polyesters in combination with polyvinylidene chloride and or polyvinyl alcohol.

10. The photographic imaging element of claim 2 wherein said tie layer and said polyolefin sheet comprises at least one material selected from the group consisting of homo- and copolymers of olefin, polyethylene terephthalate, polybutylterephthalate, diacetyl and triacetyl cellulose, polycarbonates, polyethylene vinyl acetate, ethylene vinyl acetate, copolymer of ethylene and/or polypropylene with vinyl acetate, homo- and copolymers of acrylonitrile, methyl, ethyl and butyl acrylate, methyl and ethyl methacrylates, metal salt of ethylene methacrylic acid copolymers, methyl vinyl ether, butyl vinyl ether, chloroethyl vinyl ether, vinyl alcohol, vinyl chloride, vinylidene chloride, vinyl fluoride, vinyl acetate, vinyl propionate, vinyl ethyl butyrate, vinyl phenyl acetate, polyester ketone, polyethylene acrylic acid, polyamides, amorphous nylons, polyhydoxyamide ether, polychlorotrifluoroethylene, polychlorotrifluoroethylene, and polytetrafluoroethylene.

11. The photographic imaging element of claim 2 wherein said barrier layer comprises a metallized layer.

12. The photographic element of claim 5 wherein said tie layer comprises polyethylene.

13. A photographic imaging element comprising a paper base, at least one photosensitive silver halide layer, a tie layer, a biaxially oriented polyolefin sheet, and a water vapor barrier layer applied to said oriented sheet wherein said polyolefin sheet by itself or in combination with said tie layer and said water vapor barrier layer applied to said oriented sheet has a water vapor transmission rate of less than $0.85\times10^{-5}$ g/mm$^2$/day.

14. The photographic imaging element of claim 13 wherein said vapor barrier layer tie layer and said polyolefin sheet comprises at least one material selected from the group consisting of homo- and copolymers of olefin, polyethylene terephthalate, polybutylterephthalate, cellulose acetates, polycarbonates, polyethylene vinyl acetate, ethylene vinyl acetate, copolymer of ethylene or polypropylene with vinyl acetate, homo- and copolymers of acrylonitrile, methyl, ethyl and butyl acrylate, methyl and ethyl methacrylates, metal salt of ethylene methacrylic acid copolymers, methyl vinyl ether, butyl vinyl ether chloroethyl vinyl ether, vinyl alcohol, vinyl chloride, vinylidene chloride, vinyl fluoride, vinyl acetate, vinyl propionate, vinyl ethyl butyrate and vinyl phenyl acetate, polyester ketone, polyethylene acrylic acid, polyamides, amorphous nylons, polyhydoxyamide ether, polychlorotrifluoroethylene, polychlorotrifluoroethylene, and polytetrafluoroethylene.

15. The photographic imaging element of claim 1 comprising a metallized layer.

16. The photographic imaging element of claim 13 wherein said barrier layer is coated from aqueous solution.

17. The photographic imaging element of claim 13 wherein said barrier layer is coated from organic solvent.

18. The photographic element of claim 13 wherein said water barrier layer comprises polyvinyl alcohol.

19. The photographic imaging element of claim 13 wherein said polyolefin sheet and photosensitive silver halide member are on the top of said element and said element further comprises a biaxially oriented polymer sheet of the back of said element.

* * * * *